US009892834B2

(12) United States Patent
Ogawa et al.

(10) Patent No.: US 9,892,834 B2
(45) Date of Patent: Feb. 13, 2018

(54) MAGNETIC MATERIAL AND COIL COMPONENT EMPLOYING SAME

(71) Applicant: TAIYO YUDEN CO., LTD., Taito-ku, Tokyo (JP)

(72) Inventors: Hideki Ogawa, Nakanojou-machi (JP); Atsushi Tanada, Nakanojou-machi (JP)

(73) Assignee: TAIYO YUDEN CO., LTD., Tokyo (JP)

( * ) Notice: Subject to any disclaimer, the term of this patent is extended or adjusted under 35 U.S.C. 154(b) by 0 days.

(21) Appl. No.: 14/141,301

(22) Filed: Dec. 26, 2013

(65) Prior Publication Data

US 2014/0104031 A1 Apr. 17, 2014

Related U.S. Application Data

(63) Continuation of application No. PCT/JP2012/054439, filed on Feb. 23, 2012.

(30) Foreign Application Priority Data

Jul. 5, 2011 (JP) ..... 2011-149579

(51) Int. Cl.
*H01F 27/24* (2006.01)
*H01F 17/04* (2006.01)
(Continued)

(52) U.S. Cl.
CPC ..... *H01F 1/408* (2013.01); *B22F 1/02* (2013.01); *B22F 3/1007* (2013.01); *B22F 3/24* (2013.01);
(Continued)

(58) Field of Classification Search
CPC ..... H01F 41/0246; H01F 27/255; H01F 3/08; H01F 1/015; B22F 2998/10; B22F 3/02
(Continued)

(56) References Cited

U.S. PATENT DOCUMENTS 2,193,768 A * 3/1940 Masumoto et al. ..... 420/78
4,129,444 A 12/1978 Dreyer et al.
(Continued)

FOREIGN PATENT DOCUMENTS

CN 1731542 A 2/2006
CN 102007549 A 4/2011
(Continued)

OTHER PUBLICATIONS

An Office Action issued by the Korean Patent Office, issued Oct. 31, 2014, for Korean counterpart application No. 10-2013-7033161.
(Continued)

*Primary Examiner* — Elvin G Enad
*Assistant Examiner* — Kazi Hossain
(74) *Attorney, Agent, or Firm* — Law Office of Katsuhiro Arai

(57) ABSTRACT

A coil component having a magnetic material and a coil formed on a surface of or inside the magnetic material. The magnetic material is constituted by a grain compact formed by compacting multiple metal grains that in turn are constituted by an Fe—Si—M soft magnetic alloy (where M is a metal element that oxidizes more easily than Fe), wherein individual metal grains have oxide film formed at least partially around them; the grain compact is formed primarily via bonding between oxide films formed around adjacent metal grains; and the apparent density of the grain compact 1 is 5.2 g/cm$^3$ or more, or preferably 5.2 to 7.0 g/cm$^3$.

7 Claims, 3 Drawing Sheets

(51) Int. Cl.

| | |
|---|---|
| ***H01F 5/00*** | (2006.01) |
| ***H01F 1/40*** | (2006.01) |
| ***B22F 1/02*** | (2006.01) |
| ***B22F 3/10*** | (2006.01) |
| ***B22F 3/24*** | (2006.01) |
| ***C22C 38/02*** | (2006.01) |
| ***C22C 38/06*** | (2006.01) |
| ***C22C 38/34*** | (2006.01) |
| ***H01F 1/26*** | (2006.01) |
| ***H01F 1/33*** | (2006.01) |
| ***H01F 1/01*** | (2006.01) |
| ***H01F 27/28*** | (2006.01) |
| *H01F 1/24* | (2006.01) |

(52) U.S. Cl.
CPC ..... *C22C 38/02* (2013.01); *C22C 38/06* (2013.01); *C22C 38/34* (2013.01); *H01F 1/015* (2013.01); *H01F 1/26* (2013.01); *H01F 1/33* (2013.01); *H01F 27/28* (2013.01); *H01F 1/24* (2013.01)

(58) Field of Classification Search
USPC ..... 336/233, 234, 221
See application file for complete search history.

(56) References Cited

U.S. PATENT DOCUMENTS

| | | | | |
|---|---|---|---|---|
| 5,352,522 | A | 10/1994 | Kugimiya et al. | |
| 5,522,946 | A | 6/1996 | Tomita et al. | |
| 6,051,324 | A | 4/2000 | Moorhead et al. | |
| 6,392,525 | B1 | 5/2002 | Kato et al. | |
| 6,432,159 | B1 | 8/2002 | Saito et al. | |
| 6,720,074 | B2 | 4/2004 | Zhang et al. | |
| 6,764,643 | B2 | 7/2004 | Sagawa et al. | |
| 6,784,782 | B2 | 8/2004 | Inoue et al. | |
| 6,814,928 | B2 | 11/2004 | Sagawa et al. | |
| 7,422,697 | B2 | 9/2008 | Takahashi et al. | |
| 7,446,638 | B2 | 11/2008 | Nogi | |
| 8,018,313 | B2 | 9/2011 | Tada et al. | |
| 8,866,579 | B2 | 10/2014 | Hachiya et al. | |
| 8,896,405 | B2 | 11/2014 | Hachiya et al. | |
| 9,349,517 | B2 | 5/2016 | Matsuura et al. | |
| 2004/0086412 | A1 | 5/2004 | Suzuki et al. | |
| 2004/0140016 | A1 | 7/2004 | Sakamoto et al. | |
| 2004/0209120 | A1 | 10/2004 | Inoue et al. | |
| 2005/0199852 | A1* | 9/2005 | Takenoshita | 252/62.57 |
| 2007/0290161 | A1* | 12/2007 | Tokuoka | B22F 1/0059 252/62.54 |
| 2008/0012679 | A1 | 1/2008 | Okabe et al. | |
| 2008/0029300 | A1* | 2/2008 | Harada et al. | 174/391 |
| 2008/0061264 | A1 | 3/2008 | Maeda et al. | |
| 2008/0152897 | A1 | 6/2008 | Maeda et al. | |
| 2008/0231409 | A1 | 9/2008 | Kugai et al. | |
| 2009/0045905 | A1 | 2/2009 | Nakagawa et al. | |
| 2009/0184794 | A1 | 7/2009 | Tsuzuki et al. | |
| 2009/0302512 | A1* | 12/2009 | Gablenz et al. | 264/612 |
| 2010/0044618 | A1* | 2/2010 | Ishimine et al. | 252/62.55 |
| 2010/0045120 | A1* | 2/2010 | Kitano et al. | 310/44 |
| 2010/0253463 | A1 | 10/2010 | Shimomura et al. | |
| 2010/0289609 | A1 | 11/2010 | Liao et al. | |
| 2011/0024670 | A1 | 2/2011 | Otsuki et al. | |
| 2011/0024671 | A1* | 2/2011 | Otsuki | B22F 1/02 252/62.54 |
| 2011/0133881 | A1 | 6/2011 | Nakajima et al. | |
| 2011/0168939 | A1 | 7/2011 | Nakamura et al. | |
| 2011/0227690 | A1* | 9/2011 | Watanabe et al. | 336/221 |
| 2011/0267167 | A1 | 11/2011 | Ogawa et al. | |
| 2011/0285486 | A1* | 11/2011 | Maeda et al. | 335/297 |
| 2011/0286143 | A1* | 11/2011 | Ikriannikov | H01F 17/04 361/268 |
| 2012/0001710 | A1* | 1/2012 | Wakabayashi et al. | 335/297 |
| 2012/0038449 | A1 | 2/2012 | Ogawa et al. | |
| 2012/0229244 | A1* | 9/2012 | Ueno et al. | 336/221 |
| 2013/0271256 | A1* | 10/2013 | Ueno et al. | 336/221 |

FOREIGN PATENT DOCUMENTS

| | | | | |
|---|---|---|---|---|
| JP | H04-147903 | A | | 5/1992 |
| JP | H04-346204 | A | | 12/1992 |
| JP | H07-201570 | A | | 8/1995 |
| JP | H09-074011 | A | | 3/1997 |
| JP | H10-241942 | A | | 9/1998 |
| JP | 2000-030925 | A | | 1/2000 |
| JP | 2000-138120 | A | | 5/2000 |
| JP | 2001-011563 | A | | 1/2001 |
| JP | 2001-118725 | A | | 4/2001 |
| JP | 2002-305108 | A | | 10/2002 |
| JP | 2002-313620 | A | | 10/2002 |
| JP | 2002-313672 | A | | 10/2002 |
| JP | 2002-343618 | A | | 11/2002 |
| JP | 2004-162174 | A | | 6/2004 |
| JP | 2005-150257 | A | | 6/2005 |
| JP | 02005150257 | A | * | 6/2005 |
| JP | 2006179621 | A | | 7/2006 |
| JP | 2007-019134 | A | | 1/2007 |
| JP | 2007-027354 | A | | 2/2007 |
| JP | 2007-123703 | A | | 5/2007 |
| JP | 2007-258427 | A | | 10/2007 |
| JP | 2007-299871 | A | | 11/2007 |
| JP | 2008-028162 | A | | 2/2008 |
| JP | 2008-041961 | A | | 2/2008 |
| JP | 2008-195986 | A | | 8/2008 |
| JP | 2009-088502 | | * | 9/2008 |
| JP | 2009-010180 | A | | 1/2009 |
| JP | 2009-088496 | A | | 4/2009 |
| JP | 2009-088502 | A | | 4/2009 |
| JP | 02009088502 | A | * | 4/2009 |
| JP | 2010-018823 | A | | 1/2010 |
| JP | 2011-249774 | A | | 12/2011 |
| TW | M388724 | U1 | | 9/2010 |
| WO | 2009/001641 | A1 | | 12/2008 |
| WO | 2009/128425 | A1 | | 10/2009 |
| WO | 2009/128427 | A1 | | 10/2009 |
| WO | 2010/013843 | A1 | | 2/2010 |
| WO | 2010113681 | A1 | | 10/2010 |
| WO | 2011/136198 | A1 | | 11/2011 |

OTHER PUBLICATIONS

International Search Report (ISR) mailed Mar. 27, 2012, issued for International application No. PCT/JP2012/054439.
An Office Action issued by USPTO, dated Nov. 5, 2015 for co-pending U.S. Appl. No. 14/129,520.
A final Office Action issued by USPTO, dated May 19, 2016 for U.S. Appl. No. 14/129,520.
Verified Partial Translation of JP2005-150257A (Edo et al., Published Jun. 9, 2005).
Non-Final Rejection issued by U.S. Patent and Trademark Office, dated Dec. 29, 2016, for related U.S. Appl. No. 14/129,520.
Non-Final Rejection issued by U.S. Patent and Trademark Office, dated Dec. 14, 2016, for related U.S. Appl. No. 15/132,102.
A Final Office Action issued by USPTO, dated Jun. 30, 2017 for co-pending U.S. Appl. No. 14/129,520.

* cited by examiner

MAGNETIC MATERIAL AND COIL COMPONENT EMPLOYING SAME

CROSS-REFERENCE TO RELATED APPLICATIONS

This application is a continuation of International Application PCT/JP2012/054439, filed Feb. 23, 2012, which claims priority to Japanese Patent Application No. 2011-149579, filed Jul. 5, 2011, each disclosure of which is herein incorporated by reference in its entirety.

BACKGROUND OF THE INVENTION

1. Field of the Invention

The present invention relates to a magnetic material used primarily as a core in a coil, inductor, etc., as well as a coil component using such magnetic material.

2. Description of the Related Art

Coil components such as inductors, choke coils and transformers (so-called inductance components) have a magnetic material and a coil formed inside or on the surface of the magnetic material. For the magnetic material, Ni—Cu—Zn ferrite or other type of ferrite is generally used.

There has been a need for these coil components of larger current capacity (higher rated current) in recent years, and switching the magnetic material from ferrite as traditionally used, to Fe—Cr—Si alloy, is being studied in order to meet such demand (refer to Patent Literature 1). Fe—Cr—Si alloy and Fe—Al—Si alloy have a higher saturated magnetic flux density than ferrite. On the other hand, their volume resistivity is much lower than that of ferrite.

Patent Literature 1 (Japanese Patent Laid-open No. 2007-027354) discloses a method of manufacturing the magnetic material part of a laminated coil component, which is to form magnetic layers using a magnetic paste containing Fe—Cr—Si alloy grains and glass component, laminate the magnetic layers with conductive patterns and sinter the laminate in a nitrogen ambience (reducing ambience), and then impregnate the sintered laminate with thermosetting resin.

Patent Literature 2 (Japanese Patent Laid-open No. 2001-11563) discloses a method of manufacturing complex magnetic material relating to a Fe—Al—Si pressed powder magnetic core used for choke coil, etc., where such manufacturing method involves pressure-compacting a mixture of alloy powder whose primary components are iron, aluminum and silicon on one hand, and binder on the other, and then heat-treating the pressure-compacted product in an oxidizing ambience.

Patent Literature 3 (Japanese Patent Laid-open No. 2002-305108) discloses a complex magnetic material that contains metal magnetic powder and thermosetting resin, where the metal magnetic powder has a specified packing factor and a specified value or higher of electrical resistivity.

SUMMARY OF THE INVENTION

However, sintered products obtained by the manufacturing methods in Patent Literatures 1 to 3 do not always provide high magnetic permeability. Also, for inductors that utilize metal magnetic material, pressed powder magnetic cores made by compacting a mixture of metal magnetic material and binder are known. Commonly used pressed powder magnetic cores do not always provide high insulation resistance.

In consideration of the above, an object of the present invention is to provide a new magnetic material offering higher magnetic permeability, or preferably achieving such high magnetic permeability and high insulation resistance at the same time, and also provide a coil component that uses such magnetic material.

After studying in earnest, the inventors completed the present invention described below.

The magnetic material proposed by the present invention is constituted by a grain compact formed by compacting multiple metal grains that in turn are constituted by an Fe—Si—M soft magnetic alloy (where M is a metal element that oxidizes more easily than Fe). Here, individual metal grains have oxide film formed at least partially around them as a result of oxidization of the metal grains, and the grain compact is formed primarily via bonds between oxide films formed around adjacent metal grains. The apparent density of the grain compact is 5.2 g/cm$^3$ or more, or preferably 5.2 to 7.0 g/cm$^3$. The definition and measurement method of apparent density are described later.

Preferably the soft magnetic alloy is an Fe—Cr—Si alloy and the oxide film contains more elemental chromium than elemental iron in mol terms.

Preferably the grain compact has voids inside and polymer resin is impregnated in at least some of the voids.

According to the present invention, a coil component having the aforementioned magnetic material and a coil formed inside or on the surface of the magnetic material is also provided.

According to the present invention, a magnetic material offering high magnetic permeability and high mechanical strength is provided. In a preferred embodiment of the present invention, a magnetic material achieving high magnetic permeability, high mechanical strength, and high insulation resistance at the same time is provided. In another preferred embodiment of the present invention, high magnetic permeability, high mechanical strength, and moisture resistance are achieved at the same time, while in a more preferable embodiment, high magnetic permeability, high mechanical strength, high insulation resistance, and moisture resistance are all achieved at the same time. Here, moisture resistance refers to minimum drop in insulation resistance even at high humidity.

DESCRIPTION OF THE SYMBOLS

Figure 1:
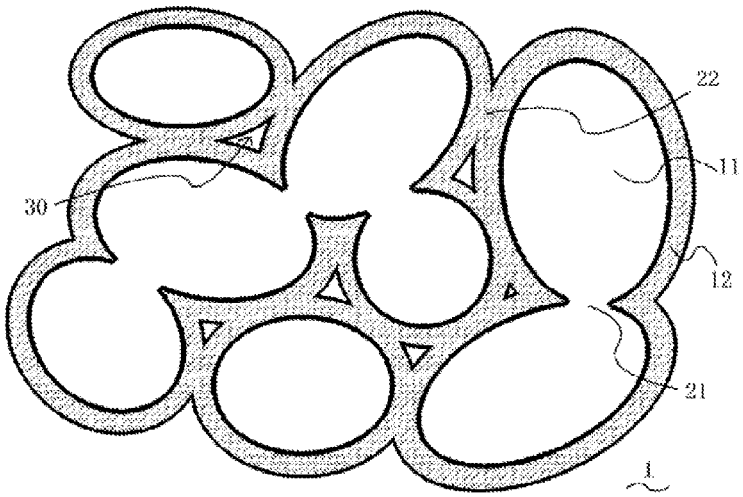
FIG. 1 is a section view providing a schematic illustration of the fine structure of a magnetic material conforming to the present invention.

1: Grain compact, 11: Metal grain, 12: Oxide film, 21: Bond between metals, 22: Bond between oxide films, 30:

Void, 40: Device that measures compact volume, 45: Sample chamber, 46: CPU, 50: Comparison chamber

DETAILED DESCRIPTION OF EMBODIMENTS

The present invention is described in detail by referring to the drawings as appropriate. It should be noted, however, that the present invention is not at all limited to the illustrated embodiments and that, because the characteristic parts of the invention may be emphasized in the drawings, the scale of each part of the drawings is not necessarily accurate.

According to the present invention, the magnetic material is constituted by a grain compact comprising specified grains aggregated in, for example, a rectangular solid or other specific shape.

Under the present invention, the magnetic material is what functions as a magnetic path in a coil, inductor or other magnetic component, and typically takes the form of a magnetic core of coil, etc.

FIG. 1 is a section view providing a schematic illustration of the fine structure of a magnetic material conforming to the present invention. Under the present invention, the grain compact 1 is understood microscopically as an aggregate of many originally independent metal grains 11 bonding together, where oxide film 12 is formed at least partially, or preferably almost completely, around individual metal grains 11 and this oxide film 12 ensures the insulation property of the grain compact 1. Adjacent metal grains 11 are bonded together, primarily by bonding together of the oxide films 12 formed around the respective metal grains 11, to constitute the grain compact 1 having a specific shape. Partially adjacent metal grains 11 can have bonds 21 between metals. Conventional magnetic materials use a hardened organic resin matrix in which single magnetic grains or bonds of several magnetic grains are dispersed, or a hardened glass component matrix in which single magnetic grains or bonds of several magnetic grains are dispersed. Under the present invention, preferably neither such organic resin matrix nor glass component matrix virtually exists.

The individual metal grains 11 are primarily constituted by specific soft magnetic alloy. Under the present invention, the metal grain 11 is constituted by an Fe—Si—M soft magnetic alloy. Here, M is a metal element that oxidizes more easily than Fe, and is typically Cr (chromium), Al (aluminum), Ti (titanium), etc., and preferably Cr or Al.

If the soft magnetic alloy is an Fe—Cr—Si alloy, the content of Si is preferably 0.5 to 7.0 percent by weight, or more preferably 2.0 to 5.0 percent by weight. A higher Si content is preferable as the resistivity and magnetic permeability become higher, while a lower Si content is associated with better formability. The preferable ranges mentioned above are proposed in consideration of the foregoing.

If the soft magnetic alloy is an Fe—Cr—Si alloy, the content of Cr is preferably 2.0 to 15 percent by weight, or more preferably 3.0 to 6.0 percent by weight. Presence of Cr is preferable in that it becomes passive state when treated with heat to suppress excessive oxidization and also express strength and insulation resistance, while less Cr is preferable from the viewpoint of improving magnetic characteristics. The preferable ranges mentioned above are proposed in consideration of the foregoing.

If the soft magnetic alloy is an Fe—Si—Al alloy, the content of Si is preferably 1.5 to 12 percent by weight. A higher Si content is preferable as the resistivity and magnetic permeability become higher, while a lower Si content is associated with better formability. The preferable range mentioned above is proposed in consideration of the foregoing.

If the soft magnetic alloy is an Fe—Si—Al alloy, the content of Al is preferably 2.0 to 8 percent by weight. The difference between Cr and Al is as follows. Fe—Si—Al provides higher magnetic permeability and volume resistivity, but is less strong, compared to Fe—Cr—Si of the same apparent density.

Note that the aforementioned preferred contents of respective metal components of soft magnetic alloy assume that the total quantity of alloy components gives 100 percent by weight. In other words, the preferred contents are calculated without considering the oxide film composition.

If the soft magnetic alloy is an Fe—Si—M alloy, preferably the remainder of Si and M is Fe except for unavoidable impurities. Metals that may be contained in addition to Fe, Si and M include magnesium, calcium, titanium, manganese, cobalt, nickel, and copper, while non-metals that may be contained include phosphorous, sulfur and carbon.

The chemical composition of the alloy constituting each metal grain 11 of the grain compact 1 can be calculated, for example, by capturing a section of the grain compact 1 with a scanning electron microscope (SEM) and then analyzing the obtained image according to the ZAF method based on energy-dispersive X-ray spectroscopy (EDS).

The magnetic material proposed by the present invention can be manufactured by compacting metal grains constituted by any specified soft magnetic alloy mentioned above and then heat-treating the metal grains. At this time, preferably heat treatment is applied in such a way that, in addition to the oxide film the material metal grains (hereinafter also referred to as "material grains") already have, some metal parts of material metal grains are oxidized to form oxide film 12. This means that, under the present invention, oxide film 12 is formed primarily by oxidization of the surface of metal grains 11. In a preferred embodiment, oxides other than those formed by oxidization of metal grains 11, such as silica and phosphate compounds, for example, are not included in the magnetic material proposed by the present invention.

Individual metal grains 11 constituting the grain compact 1 have oxide film 12 formed around them. Oxide film 12 may be formed in the material grain stage before the grain compact 1 is formed, or oxide film may be generated in the compaction process by keeping oxide film non-existent or extremely little in the material grain stage. Presence of oxide film 12 can be recognized by contrast (brightness) difference on an image taken by a scanning electron microscope (SEM) at a magnification of 3000 times or so. Presence of oxide film 12 assures insulation property of the magnetic material as a whole.

Preferably the oxide film 12 contains more metal element M than elemental iron in mol terms. One way to obtain oxide film 12 of such constitution is to make sure the material grains for magnetic material contain as little iron oxide as possible or keep the content of iron oxide to the absolute minimum, and oxidize the surface of the alloy by means of heat treatment, etc., during the process of obtaining the grain compact 1. When heat treatment, etc., is applied this way, metal M that oxidizes more easily than iron is selectively oxidized and consequently the mol ratio of metal M in the oxide film 12 becomes relatively higher than that of iron. One advantage of the oxide film 12 containing more metal element M than elemental iron is that excessive oxidization of alloy grains is suppressed.

The method of measuring the chemical composition of the oxide film 12 in the grain compact 1 is as follows. First, the grain compact 1 is fractured or otherwise its cross section is exposed. Next, the cross section is smoothed by means of ion milling, etc., and then captured with a scanning electron microscope (SEM), followed by composition calculation of the oxide film 12 according to the ZAF method based on energy dispersive X-ray spectroscopy (EDS).

The content of metal M in oxide film 12 is preferably 1.0 to 5.0 mol, or more preferably 1.0 to 2.5 mol, or even more preferably 1.0 to 1.7 mol, per 1 mol of Fe. Any higher content is preferable in terms of suppressing excessive oxidization, while any lower content is preferable in terms of sintering the space between metal grains. Methods to increase the content includes heat-treating in a weak oxidizing ambience, for example, while the methods to decrease the content includes heat-treating in a strong oxidizing ambience, for example.

In the grain compact 1, bonds between grains are primarily bonds 22 between oxide films 12. Presence of bonds 22 between oxide films 12 can be clearly determined by, for example, visually identifying on a SEM-observed image enlarged to approx. 3000 times, etc., that the oxide films 12 on adjacent metal grains 11 have the same phase. Presence of bonds 22 between oxide films 12 improves mechanical strength and insulation property. Preferably oxide films 12 on adjacent metal grains 11 are bonded together over the entire grain compact 1, but mechanical strength and insulation property will improve to some extent so long as they are bonded at least partially, and this pattern is also considered an embodiment of the present invention. Favorably the number of bonds 22 between oxide films 12 is equal to or greater than the number of metal grains 11 contained in the grain compact 1. Also, as described later, bonding 21 between metal grains 11 that does not involve bonding between oxide films 12 may be present in some parts. Furthermore, a mode (not illustrated) where adjacent metal grains 11 are only physically contacting or in close proximity with each other in the absence of bonding between oxide films 12 or bonding between metal grains 11 may be present in some parts.

Methods to generate bonds 22 between oxide films 12 include, for example, applying heat treatment at the specified temperature described later in an ambience where oxygen is present (such as air) when the grain compact 1 is manufactured.

According to the present invention, not only bonds 22 between oxide films 12 but bonds 21 between metal grains 11 may be present in the grain compact 1. In the same manner with bonds 22 between oxide films 12 as mentioned above, presence of bonds 21 between metal grains 11 can be clearly determined by, for example, visually confirming on a SEM-observed image enlarged to approx. 3000 times, etc., that adjacent metal grains 11 have the same phase as well as bonding points. Presence of bonds 21 between metal grains 11 improves magnetic permeability further.

Methods to generate bonding parts 21 where metal grains 11 are bonded directly together include, for example, using material grains having less oxide film on them, adjusting the temperature and partial oxygen pressure as described later during the heat treatment needed to manufacture the grain compact 1, and adjusting the compacting density at which to obtain the grain compact 1 from the material grains. It can be proposed that the heat treatment temperature is enough to bond the metal grains 11 together, while keeping the generation of oxide to a minimum. The specific preferable temperature ranges are mentioned later. The partial oxygen pressure may be that in air, for example, and the lower the partial oxygen pressure, the less likely the generation of oxide becomes and consequently the more likely the metal-to-metal bonding of metal grains 11 becomes.

According to the present invention, the grain compact 1 has a specified apparent density. The apparent density represents the weight of the grain compact 1 per unit volume. The apparent density is different from the characteristic density of the substance constituting the grain compact 1 and, for example, presence of voids 30 in the grain compact 1 leads to a lower apparent density. The apparent density is dependent on the characteristic density of the very substance constituting the grain compact 1, and also on the denseness of arrangement of metal grains 11 when the grain compact 11 is formed.

The apparent density of the grain compact 1 is 5.2 g/cm$^3$ or more, or preferably 5.2 to 7.0 g/cm$^3$, or more preferably 5.6 to 6.9 g/cm$^3$, or most preferably 6.0 to 6.7 g/cm$^3$. An apparent density of 5.2 g/cm$^3$ or more improves magnetic permeability, while an apparent density of 7.0 g/cm$^3$ or less achieves high magnetic permeability and high insulation resistance at the same time.

The measurement method of apparent density is described below.

Figure 2:
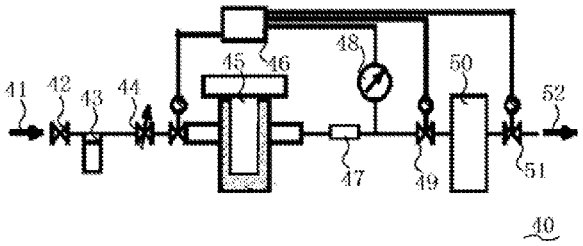
FIG. 2 is a schematic diagram of a device that measures grain compact volume.

First, the compact volume $V_P$ is measured by the "Gas Replacement Method" according to JIS R1620-1995. For the measuring device, the Ultrapycnometer 1000 by Quantachrome Instruments can be used, for example. FIG. 2 is a schematic diagram of a device that measures compact volume. With this measuring device 40, gas (typically helium gas) is introduced as indicated by an arrow 41, after which the gas travels through a valve 42, safety valve 43 and flow rate control valve 44, passes through a sample chamber 45, and travels further through a filter 47 and solenoid valve 49, before entering a comparison chamber 50. Thereafter, the gas is released from the measurement system via a solenoid valve 51 as indicated by another arrow 52. The device 40 is equipped with a pressure gauge 48 and is controlled by a CPU 46.

Here, the volume $V_P$ of the compact being measured is calculated as follows:

$$V_P = V_C - V_A / \{(p_1/p_2) - 1\}$$

Note that $V_C$ represents the volume of the sample chamber 45, $V_A$ represents the volume of the comparison chamber 50, $p_1$ represents the internal pressure of the system when the sample chamber 45 is pressurized to the atmospheric pressure or above with a sample placed inside, and $p_2$ represents the internal pressure of the system resulting from opening the solenoid valve 49 when the internal pressure is $p_1$.

Once the volume $V_P$ of the compact has been measured as above, the next step is to measure the mass M of the compact using an electronic balance. The apparent density is calculated as $M/V_P$.

Under the present invention, the material system that constitutes the grain compact 1 is roughly fixed, so the apparent density is primarily controlled by the denseness of arrangement of metal grains 11. The apparent density can be increased primarily by making the arrangement of metal grains 11 denser, while it can be decreased primarily by making the arrangement of metal grains 11 sparser, for example. With the material system used by the present invention, the apparent density is expected to become approx. 5.6 g/cm$^3$ when the individual metal grains 11 are assumed to be spherical and packed to the maximum density. To increase the apparent density further, large grains and small grains can be mixed as metal grains 11 so that small grains fill the voids 30 in the large-grain packed structure. The apparent density can be adjusted as deemed appropriate by referencing the results of examples described later, for example, for specific control methods.

According to one preferred embodiment, the material grains mentioned later are prepared by mixing material grains whose d50 is 10 to 30 μm and Si content is 2 to 4 percent by weight, with material grains whose d50 is 3 to 8 μm and Si content is 5 to 7 percent by weight. This way, the relatively larger material grains of relatively lower Si content undergo plastic deformation when pressurized, and the relatively smaller grains of relatively higher Si content fill the gaps between these relatively large grains, and consequently the apparent density improves.

According to another preferred embodiment, material grains whose d50 is 10 to 30 μm and Si content is 5 to 7 percent by weight are combined with material grains whose d50 is 3 to 8 μm and Si content is 2 to 4 percent by weight.

According to yet another preferred embodiment, the pressure mentioned later which is applied to the material grains when they are compacted, prior to heat treatment, is increased to improve the apparent density, where such higher pressure is specifically 1 to 20 t/cm$^2$, for example, or preferably 3 to 13 t/cm$^2$.

According to yet another preferred embodiment, the temperature mentioned later at which the material grains are compacted, prior to heat treatment, is adjusted to a specified range to control the apparent density. To be specific, the higher the temperature, the more the apparent density improves. Specific temperatures are 20 to 120° C., or preferably 25 to 80° C., for example, and preferably the aforementioned pressures are applied at temperatures in these ranges to perform compaction.

According to yet another preferred embodiment, the amount of the lubricant mentioned later that can be applied during compaction (prior to heat treatment) is adjusted to control the apparent density. The apparent density of the grain compact 1 increases when the amount of lubricant is adjusted to an appropriate level. Specific amounts of lubricant are mentioned later.

For the metal grains (material grains) used as the material for manufacturing the magnetic material proposed by the present invention, preferably grains constituted by an Fe—M—Si alloy, or more preferably grains constituted by an Fe—Cr—Si alloy, are used. The alloy composition of the material grains is reflected in the alloy composition of the magnetic material finally obtained. Accordingly, a desired alloy composition can be selected for the material grains as deemed appropriate according to the alloy composition of the magnetic material to be finally obtained, where preferred composition ranges for the material grains are the same as the preferred composition ranges for the magnetic material as mentioned earlier. Individual material grains may be covered with oxide film. In other words, individual material grains may be constituted by specified soft magnetic alloy at the center as well as oxide film formed at least partially around the soft magnetic alloy as a result of oxidization of the soft magnetic alloy.

The sizes of individual material grains are virtually equal to the sizes of grains constituting the grain compact 1 in the magnetic material finally obtained. Considering the magnetic permeability and in-grain eddy current loss, the material grain size is preferably 2 to 30 μm, or more preferably 2 to 20 μm, or most preferably 3 to 13 μm, in terms of d50. The d50 of the material grain can be measured using a measuring device that uses laser diffraction/scattering. In addition, the d10 is preferably 1 to 5 μm, or more preferably 2 to 5 μm. Furthermore, the d90 is preferably 4 to 30 μm, or more preferably 4 to 27 μm. Preferred embodiments using material grains of different sizes to control the apparent density of the grain compact 1 are given below.

The first preferred embodiment is to mix 10 to 30 percent by weight of material grains whose d50 is 5 to 8 μm, with 70 to 90 percent by weight of material grains whose d50 is 9 to 15 μm.

For controlling the apparent density of the grain compact 1 by mixing material grains of different grain sizes, Example 3 and Example 9 mentioned later can be referenced, for example.

The second preferred embodiment is to mix 8 to 25 percent by weight of material grains whose d50 is 6 to 10 μm, with 75 to 92 percent by weight of material grains whose d50 is 12 to 25 μm.

Material grains may be those manufactured by the atomization method, for example. As mentioned earlier, bonds 22 via oxide film 12 are present in the grain compact 1 and therefore preferably oxide film is present on the material grains.

The ratio of metal and oxide film in the material grain can be quantified as follows. The material grain is analyzed by XPS by focusing on the peak intensity of Fe, and the integral value of peaks at which Fe exists as metal (706.9 eV), or $Fe_{Metal}$, and integral value of peaks at which Fe exists as oxide, or $Fe_{Oxide}$, are obtained, after which $Fe_{Metal}/(Fe_{Metal}+Fe_{Oxide})$ is calculated to quantify the ratio. Here, the calculation of $Fe_{Oxide}$ involves fitting with the measured data based on normal distribution layering around the binding energies of three types of oxides, namely $Fe_2O_3$ (710.9 eV), FeO (709.6 eV) and $Fe_3O_4$ (710.7 eV). As a result, $Fe_{Oxide}$ is calculated as the sum of integral areas isolated by peaks. Preferably the above value is 0.2 or greater from the viewpoint of enhancing the magnetic permeability as a result of promoting the generation of bonds 21 between metals during heat treatment. The upper limit of the above value is not specified in any way, but it can be 0.6, for example, from the viewpoint of manufacturing ease, and a preferable upper limit is 0.3. Methods to raise the above value include heat-treating the material grains in a reducing ambience prior to compaction, removing the surface oxide layer using acid or applying other chemical treatment, for example.

For the aforementioned material grain, any known alloy grain manufacturing method may be adopted, or PF20-F by Epson Atmix, SFR-FeSiAl by Nippon Atomized Metal Powders or other commercial product may be used. If a commercial product is used, it is highly likely that the aforementioned value of $Fe_{Metal}$ $(Fe_{Metal}+Fe_{Oxide})$ is not considered and therefore it is preferable to screen material grains or apply the aforementioned heat treatment, chemical treatment, or other pretreatment.

The method to obtain a compact from the material grain is not limited in any way, and any known means for grain compact manufacturing can be adopted as deemed appropriate. The following explains a typical manufacturing method of compacting the material grains under non-heating conditions and then applying heat treatment. However, the present invention is not at all limited to this manufacturing method.

When compacting the material grains under non-heating conditions, it is preferable to add organic resin as binder. For the organic resin, it is preferable to use one constituted by PVA resin, butyral resin, vinyl resin, or other resin whose thermal decomposition temperature is 500° C. or below, as less binder will remain after the heat treatment. Any known lubricant may be added at the time of compacting. The lubricant may be organic acid salt, etc., where specific examples include zinc stearate and calcium stearate. The amount of lubricant is preferably 0 to 1.5 parts by weight, or more preferably 0.1 to 1.0 part by weight, or most preferably 0.15 to 0.45 part by weight, or particularly preferably 0.15 to 0.25 part by weight, relative to 100 parts by weight of material grains. When the amount of lubricant is 0, it means lubricant is not used at all. After adding binder and/or lubricant to the material grains as desired, the mixture is agitated and then compacted to a desired shape. At the time of compaction, 2 to 20 t/cm$^2$ of pressure may be applied, for example, or the compaction temperature may be adjusted to 20 to 120° C., for example.

A preferred embodiment of heat treatment is explained.

Preferably heat treatment is performed in an oxidizing ambience. To be more specific, the oxygen concentration is preferably 1% or more during heating, as it promotes the generation of both bonds 22 between oxide films and bonds 21 between metals. Although the upper limit of oxygen concentration is not specified in particular, the oxygen concentration in air (approx. 21%) may be used, for example, in consideration of manufacturing cost, etc. The heating temperature is preferably 600° C. or above from the viewpoint of generating oxide film 12 and thereby promoting the generation of bonds between oxide films 12, and 900° C. or below from the viewpoint of suppressing oxidization to an appropriate level in order to maintain the presence of bonds 21 between metals and thereby enhance magnetic permeability. More preferably the heating temperature is 700 to 800° C. Preferably the heating time is 0.5 to 3 hours from the viewpoint of promoting the generation of both bonds 22 between oxide films 12 and bonds 21 between metals. The mechanism by which bonds via oxide film 12 and bonds 21 between metal grains generate is considered similar to the mechanism of so-called ceramics sintering in a high temperature range of approx. 600° C. or above, for example. That is to say, according to the new knowledge gained by the inventors, it is important in this heat treatment that (A) oxide film comes in full contact with an oxidizing ambience while metal elements are supplied from metal grains as needed so that the oxide film itself will grow, and that (B) adjacent oxide films contact each other directly to allow for inter-diffusion of the substances constituting the oxide films. Accordingly, preferaby thermosetting resins, silicone and other substances that may remain in a high-temperature range of 600° C. or above are virtually non-existent during heat treatment.

The obtained grain compact 1 may have voids 30 inside. Polymer resin (not illustrated) may be impregnated in at least some of the voids 30 present inside the grain compact 1. Methods to impregnate polymer resin include, for example, soaking the grain compact 1 in polymer resin in liquid state, solution of polymer resin or other liquefied polymer resin and then lowering the pressure of the manufacturing system, or applying the aforementioned liquefied polymer resin onto the grain compact 1 and letting it seep into the voids 30 near the surface. Impregnating polymer resin in the voids 30 in the grain compact 1 is beneficial in that it increases strength and suppresses hygroscopic property, which specifically means that moisture does not enter the grain compact 1 easily at high humidity and consequently insulation resistance does not drop easily. The polymer resin is not limited in any way and may be epoxy resin, fluororesin or other organic resin, or silicone resin, among others.

The grain compact 1 thus obtained exhibits high magnetic permeability of 20 or more, for example, or preferably 30 or more, or more preferably 35 or more, as well as flexural breaking strength (mechanical strength) of 4.5 kgf/mm$^2$ or more, for example, or preferably 6 kgf/mm$^2$ or more, or more preferably 8.5 kgf/mm$^2$ or more, and in a preferred embodiment, it also exhibits high specific resistivity of 500 Ω·cm or more, for example, or preferably $10^3$ Ω·cm or more.

According to the present invention, the magnetic material constituted by such grain compact 1 can be used as a constituent of various electronic components. For example, the magnetic material conforming to the present invention may be used as a core, with an insulating sheathed conductive wire wound around it, to form a coil. Or, green sheets containing the aforementioned material grains may be formed using any known method, followed by printing or otherwise applying a conductive paste onto the green sheets in a specific pattern and then laminating the printed green sheets and pressurizing the laminate, followed further by heat treatment under the aforementioned conditions, to obtain an inductor (coil component) having a coil formed inside the grain-compact magnetic material conforming to the present invention. In addition, various coil components may be obtained by forming a coil inside or on the surface of the magnetic material conforming to the present invention. The coil component can be any of the various mounting patterns such as surface mounting and through hole mounting, and for the means to obtain a coil component from the magnetic material, including the means to constitute the coil component of any such mounting pattern, any known manufacturing method in the electronics component field may be adopted as deemed appropriate.

EXAMPLES

The present invention is explained specifically below using examples. It should be noted, however, that the present invention is not at all limited to the embodiments described in these examples.

Examples 1 to 7

(Material Grain)

A commercial alloy powder manufactured by the atomization method, having a composition of 4.5 percent by weight of Cr, 3.5 percent by weight of Si and Fe constituting the remainder, and grain size distribution of d50 being 10 μm, d10 being 4 μm and d90 being 24 μm, was used as the material grain. An aggregate surface of this alloy powder was analyzed by XPS and the aforementioned $Fe_{Metal}/(Fe_{Metal}+Fe_{Oxide})$ was calculated as 0.5.

(Manufacturing of Grain Compact)

One hundred parts by weight of material grains thus prepared were mixed under agitation with 1.5 parts by weight of PVA binder whose thermal decomposition temperature is 300° C., after which 0.2 part by weight of zinc stearate was added as lubricant. Then, the mixture was compacted at each temperature specified in Table 1 and each pressure specified in Table 1, after which the compact was heat-treated at 750° C. for 1 hour in an oxidizing ambience of 21% in oxygen concentration, to obtain a grain compact.

Example 8

A commercial alloy powder manufactured by the atomization method, having a composition of 5.5 percent by weight of Al, 9.7 percent by weight of Si and Fe constituting the remainder, and grain size distribution of d50 being 10 μm, d10 being 3 μm and d90 being 27 μm, was used as the material grain, which was processed in the same manner as in Example 1, to obtain a grain compact. However, the compaction temperature and compaction pressure prior to heat treatment were changed as shown in Table 1.

(Evaluation)

Figure 3:
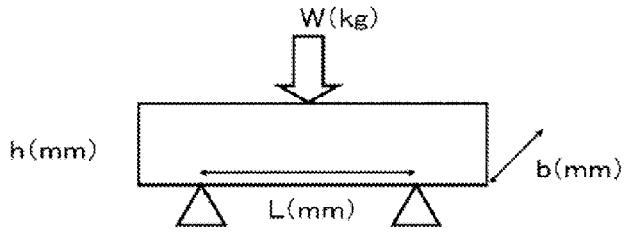
FIG. 3 is a schematic diagram explaining how 3-point flexural breaking stress is measured.

Each obtained grain compact was measured for apparent density, magnetic permeability, specific resistance and 3-point flexural breaking strength, respectively. FIG. 3 is a schematic diagram explaining how 3-point flexural breaking strength was measured. Load was applied, as shown, to the measuring target (sheet-shaped grain compact of 50 mm in length, 10 mm in width and 4 mm in thickness) and the load W at which the measuring target broke was measured. The 3-point flexural breaking stress σ was calculated according to the formula below by considering the bending moment M and geometrical moment of inertia I:

$$\sigma=(M/I)\times(h/2)=3WL/2bh2$$

Magnetic permeability was measured as follows. A coil constituted by urethane sheathed copper wire of 0.3 mm in diameter was wound around each obtained grain compact (toroidal shape of 14 mm in outer diameter, 8 mm in inner diameter and 3 mm in thickness) 20 turns to obtain a test sample. Saturated magnetic flux density Bs was measured using a vibrating sample magnetometer (VSM manufactured by Toei Industry), while magnetic permeability μ was measured at a measurement frequency of 100 kHz using a LCR meter (4285A manufactured by Agilent Technologies).

Figure 4:
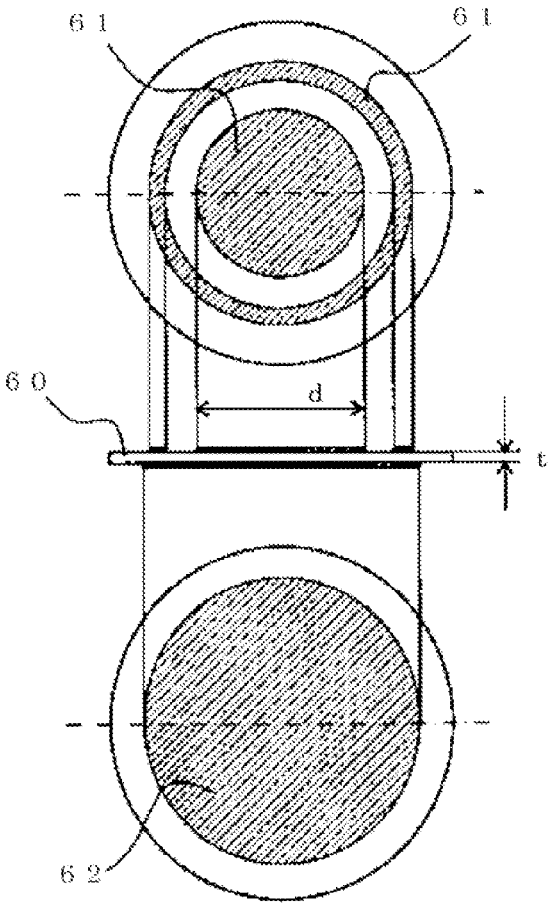
FIG. 4 is a schematic diagram explaining how specific resistance is measured.

Specific resistance was measured according to JIS-K6911 as follows. FIG. 4 is a schematic diagram explaining how specific resistance was measured. A disc-shaped test piece 60 whose surface electrode 61 had an inner circle of outer diameter d, and which had a diameter of 100 mm and thickness t (=0.2 cm), was measured for volume resistance $R_v$ (Ω), and specific resistance (volume resistivity) $\rho_v$ (Ωcm) was calculated according to the formula below:

$$\rho_v=\pi d^2 R_v/(4t)$$

When the grain compacts in Examples 1 to 8 were SEM-observed (at 3000 times), oxide film 12 was formed around individual metal grains 11 and a majority of metal grains 11 had bonds between oxide films 12 with adjacent metal grains 11, confirming that the grain compact 1 as a whole had a virtually continuous structure.

The manufacturing conditions and measured results of Examples 1 to 8 are summarized in Table 1.

TABLE 1

| | Compaction temperature ° C. | Compaction pressure ton/cm$^2$ | Apparent density g/cm$^3$ | Magnetic permeability | Specific resistance ×10$^5$Ω · cm | Flexural breaking strength kgf/mm$^2$ |
|---|---|---|---|---|---|---|
| Example 1 | 25 | 2 | 5.25 | 23.5 | 120 | 5.1 |
| Example 2 | 25 | 4 | 5.72 | 30.3 | 8.3 | 6.4 |
| Example 3 | 25 | 6 | 6.00 | 36.8 | 4.2 | 9.0 |
| Example 4 | 25 | 9 | 6.13 | 41.8 | 2.5 | 10.7 |
| Example 5 | 25 | 12 | 6.37 | 47.5 | 1.3 | 13.6 |
| Example 6 | 80 | 12 | 6.64 | 56.3 | 0.12 | 16.3 |
| Example 7 | 80 | 20 | 6.90 | 71.2 | 0.03 | 18.7 |
| Example 8 | 80 | 12 | 5.28 | 44.3 | 58 | 4.8 |

Comparative Examples 1 to 6

One hundred parts by weight of material grains of the same type used in Example 1 were mixed under agitation with 2.4 parts by weight of liquid epoxy resin mixture, to which 0.2 part by weight of zinc stearate was added as lubricant. The liquid epoxy resin mixture was constituted by 100 parts by weight of epoxy resin, 5 parts by weight of curing agent, 0.2 parts by weight of imidazole catalyst, and 120 parts by weight of solvent. Thereafter, the mixture was compacted to a specified shape at 25° C. and each pressure specified in Table 2, and then heat-treated for approx. 1 hour at 150° C. to cure the epoxy resin, to obtain each of the grain compacts of Comparative Examples 1 to 5. Separately, 100 parts by weight of material grains of the same type used in Example 8 were mixed under agitation with 2.4 parts by weight of the liquid epoxy resin mixture of the aforementioned composition, to which 0.2 parts by weight of zinc stearate was added as lubricant. Thereafter, the mixture was compacted to a specified shape at 25° C. and the pressure specified in Table 2, and then heat-treated for approx. 1 hour at 150° C. to cure the epoxy resin, to obtain the grain compact of Comparative Example 6. In other words, Comparative Examples 1 to 6, where heat treatment at 600° C. or above was omitted, each produced a material corresponding to a so-called metal composite as heretofore known, which was specifically constituted by a matrix of cured epoxy resin in which lubricant and metal grains were mixed together, where adjacent metal grains virtually had no bonding between oxide films or bonding between metals. The manufacturing conditions and measured results of Comparative Examples 1 to 6 are summarized in Table 2.

TABLE 2

| | Compaction temperature ° C. | Compaction pressure ton/cm$^2$ | Apparent density g/cm$^3$ | Magnetic permeability |
|---|---|---|---|---|
| Comparative Example 1 | 25 | 2 | 5.22 | 21.8 |
| Comparative Example 2 | 25 | 5 | 5.67 | 26.5 |
| Comparative Example 3 | 25 | 8 | 5.90 | 29.2 |
| Comparative Example 4 | 25 | 12 | 6.01 | 30.4 |
| Comparative Example 5 | 25 | 15 | 6.32 | 36.7 |
| Comparative Example 6 | 25 | 12 | 5.25 | 37.2 |

Figure 5:
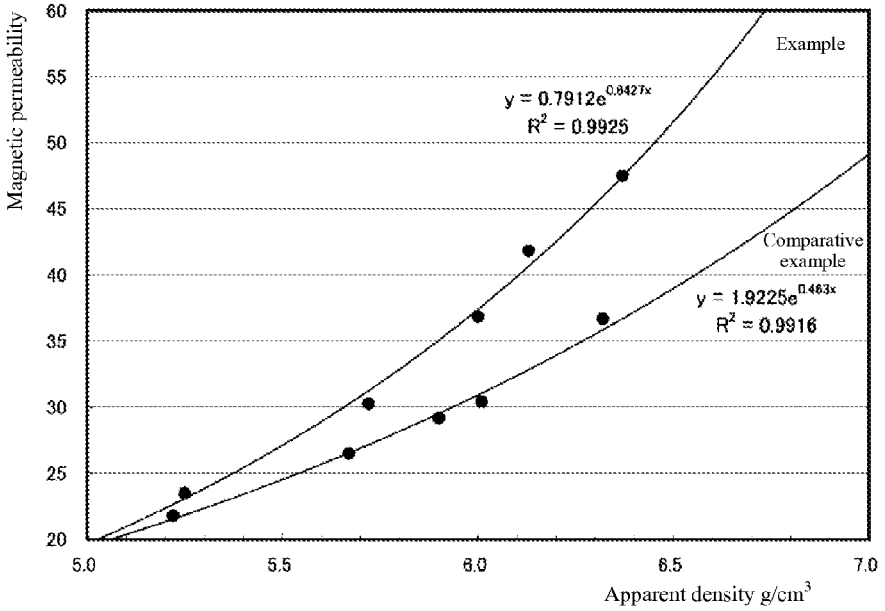
FIG. 5 is a graph plotting magnetic permeability as a function of apparent density, showing the measured results of examples and comparative examples of the present invention.

FIG. 5 is a graph plotting magnetic permeability as a function of apparent density, showing the measured results of Examples 1 to 5 and Comparative Examples 1 to 5. When x represents apparent density and y represents magnetic permeability, Examples 1 to 5 had an approximation expression of $y=0.7912e^{0.6427x}$ ($R^2=0.9925$), while Comparative Examples 1 to 5 had an approximation expression of $y=1.9225e^{0.463x}$ ($R^2=0.9916$). As shown in FIG. 5, the grain compacts conforming to the present invention, containing no binder and having an apparent density of 5.2 or more, exhibited markedly higher levels of magnetic permeability compared to the conventional metal composites.

Note that, with Example 5, a section of the grain compact was captured with a scanning electron microscope (SEM) and the composition was calculated according to the ZAF method based on energy-dispersive X-ray spectroscopy (EDS), as mentioned earlier, to perform element analysis of oxide film. As a result, the oxide film contained 1.6 mols of chromium per 1 mol of iron.

Figure 6:
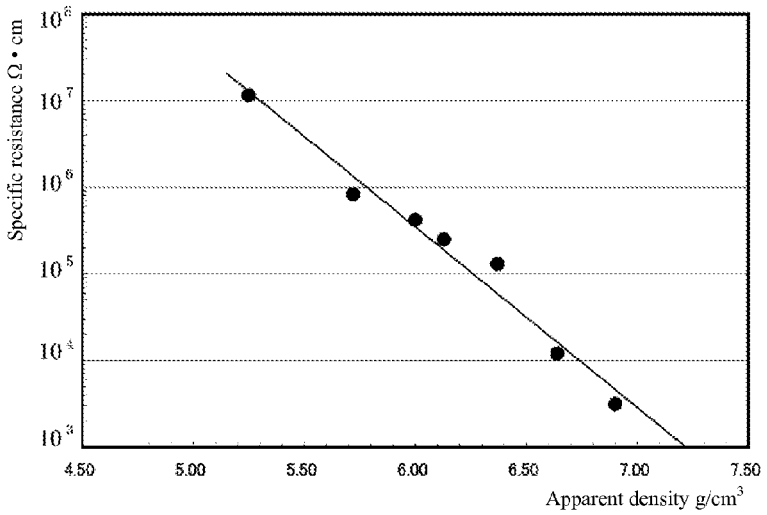
FIG. 6 is a graph plotting specific resistance as a function of apparent density, showing the measured results of examples of the present invention.

FIG. 6 is a graph plotting specific resistance as a function of apparent density, showing the measured results of Examples 1 to 7. Clearly the grain compacts whose apparent density was 7.0 g/cm$^3$ or less had a sufficiently high specific resistance of 500 Ω·cm or more.

Example 9

A mixed powder consisting of 15 percent by weight of an alloy powder having the same chemical composition as the powder used in Examples 1 to 7 and d50 of 5 μm, and 85 percent by weight of alloy grains having the same chemical composition as the alloy grains used in Examples 1 to 7 and d50 of 10 μm, was used as the material grains, which were processed in the same manner as in Example 3 to obtain a grain compact with an apparent density of 6.27 g/cm$^3$. A comparison of Examples 3 and 9 found that a grain compact of higher apparent density could be obtained by replacing some of material grains with grains of smaller size.

We claim:

1. A coil component having a magnetic material and a coil formed on a surface of or inside the magnetic material, said magnetic material constituted by a sintered grain compact formed by compacting and heating multiple soft magnetic alloy grains, referred to as metal grains, containing Fe and a metal element that oxidizes more easily than Fe;

wherein individual metal grains have oxide film formed substantially all around the metal grains, said oxide film consisting of oxide of the metal grains;

wherein the metal grains are bonded together only by two types of bonding consisting of oxide-to-oxide bonding where oxide films formed around adjacent metal grains are bonded together, and metal-to-metal bonding where metals of adjacent metal grains are bonded together without intervening oxide films and the adjacent metal grains have a same phase as well as bonding points"; and wherein an apparent density of the grain compact as expressed by $M/V_P$ is 5.2 g/cm$^3$ or more but 7.0 g/cm$^3$ or less, where M represents a mass of the grain compact sample, while $V_P$ represents a volume of the grain compact as measured by a gas replacement method, said grain compact having a higher magnetic permeability as compared with a magnetic permeability of a grain compact having the same apparent density and using the same metal grains but bonded by resin.

2. A coil component according to claim 1, wherein the grain compact is constituted by a mixture of metal grains having different compositions.

3. A coil component according to claim 2, wherein the grain compact contains Cr or Al.

4. A coil component according claim 2, wherein the grain compact is constituted by a mixture of groups of metal grains having different grain size distributions defined by d50.

5. A coil component according to claim 1, wherein the grain compact is formed partially via metal-to-metal bonding between adjacent metal grains.

6. A coil component according to claim 1, wherein the grain compact has voids inside.

7. A coil component according to claim 1, wherein the grain compact includes no organic resin or glass component.

* * * * *